US009731937B2

(12) United States Patent
Steiner et al.

(10) Patent No.: US 9,731,937 B2
(45) Date of Patent: Aug. 15, 2017

(54) ADJUSTABLE ROLLER-GUIDE SHOE

(71) Applicant: Inventio AG, Hergiswil (CH)

(72) Inventors: Hubert Steiner, Ebikon (CH); Stephan Hess, Emmenbrücke (CH)

(73) Assignee: INVENTIO AG, Hergiswil (CH)

( * ) Notice: Subject to any disclaimer, the term of this patent is extended or adjusted under 35 U.S.C. 154(b) by 335 days.

(21) Appl. No.: 14/413,731

(22) PCT Filed: Jul. 4, 2013

(86) PCT No.: PCT/EP2013/064158

§ 371 (c)(1),
(2) Date: Apr. 27, 2015

(87) PCT Pub. No.: WO2014/009253

PCT Pub. Date: Jan. 16, 2014

(65) Prior Publication Data

US 2015/0291392 A1 Oct. 15, 2015

(30) Foreign Application Priority Data

Jul. 12, 2012 (EP) ..... 12176134

(51) Int. Cl.
*B66B 7/04* (2006.01)

(52) U.S. Cl.
CPC ..... *B66B 7/046* (2013.01)

(58) Field of Classification Search
CPC ..... B66B 7/042; B66B 7/046
See application file for complete search history.

(56) References Cited

U.S. PATENT DOCUMENTS 1,854,976 A * 4/1932 Brady ..... B66B 7/046 187/406
2,100,169 A * 11/1937 Norton ..... B66B 7/046 187/406
2,498,299 A * 2/1950 Rissler ..... B66B 7/046 187/406
3,099,334 A * 7/1963 Tucker, Jr. ..... B66B 7/046 187/406
3,856,117 A 12/1974 Solymos
(Continued)

FOREIGN PATENT DOCUMENTS

FR 1591623 A 5/1970
JP 2000159458 A 6/2000

*Primary Examiner* — Michael Riegelman
(74) *Attorney, Agent, or Firm* — Shumaker, Loop & Kendrick, LLP; William J. Clemens

(57) ABSTRACT

An adjustable roller-guide shoe for guiding an elevator car or a counterweight of an elevator installation contains a roller carrier, which can be fastened on the car or the counterweight, a guide roller and a roller spindle, which is arranged in the roller carrier and accommodates the guide roller. The roller spindle is positioned in the roller carrier by an adapter having an installation contour which matches a corresponding accommodating contour of the roller carrier. The adapter is configured to be fixed in different installation positions in relation to the roller carrier, and thus the roller spindle can be placed in different positions in the roller carrier, depending on the installation position of the adapter. It is thus possible for the roller-guide shoe to be operated with different roller diameters or to be adapted to different rail-web dimensions.

13 Claims, 6 Drawing Sheets

(56) References Cited

U.S. PATENT DOCUMENTS

| | | | | |
|---|---|---|---|---|
| 5,107,963 | A | 4/1992 | Rocca et al. | |
| 6,345,698 | B1 * | 2/2002 | Ravishankar | B66B 7/048 187/409 |
| 2005/0279585 | A1 | 12/2005 | Race et al. | |
| 2015/0232301 | A1 * | 8/2015 | Sakuma | B66B 7/046 187/410 |
| 2015/0321885 | A1 * | 11/2015 | Laughton | B66B 7/048 187/410 |

* cited by examiner

Fig. 7
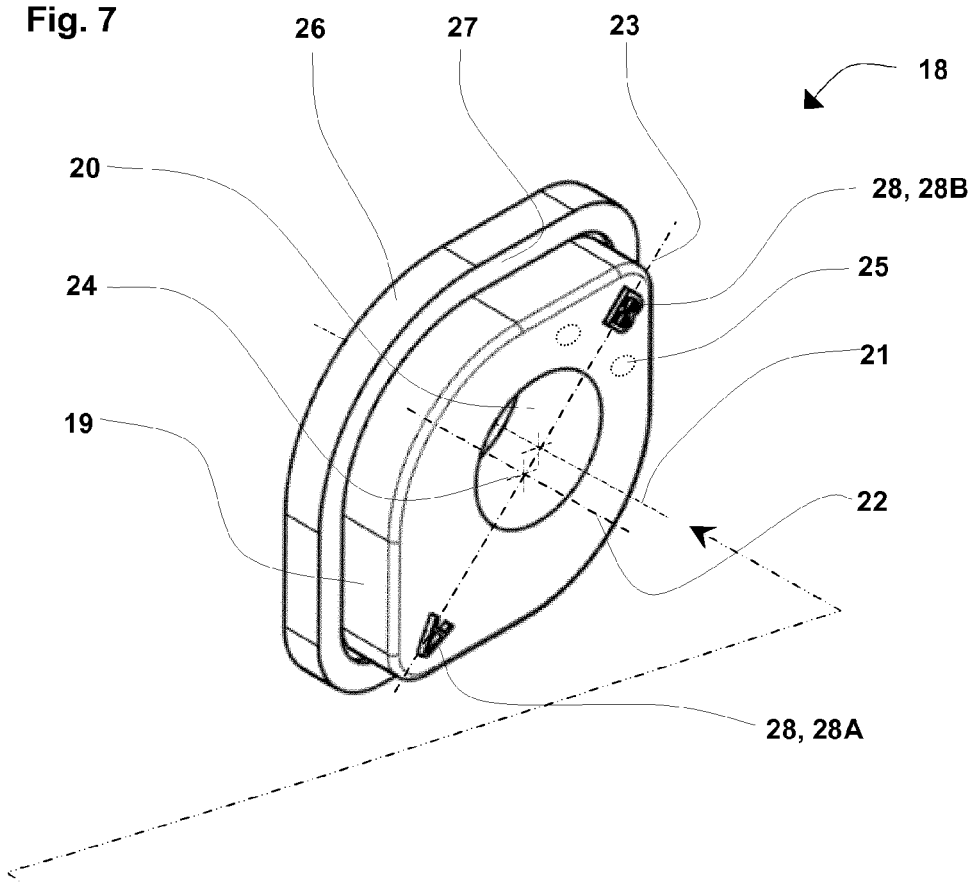
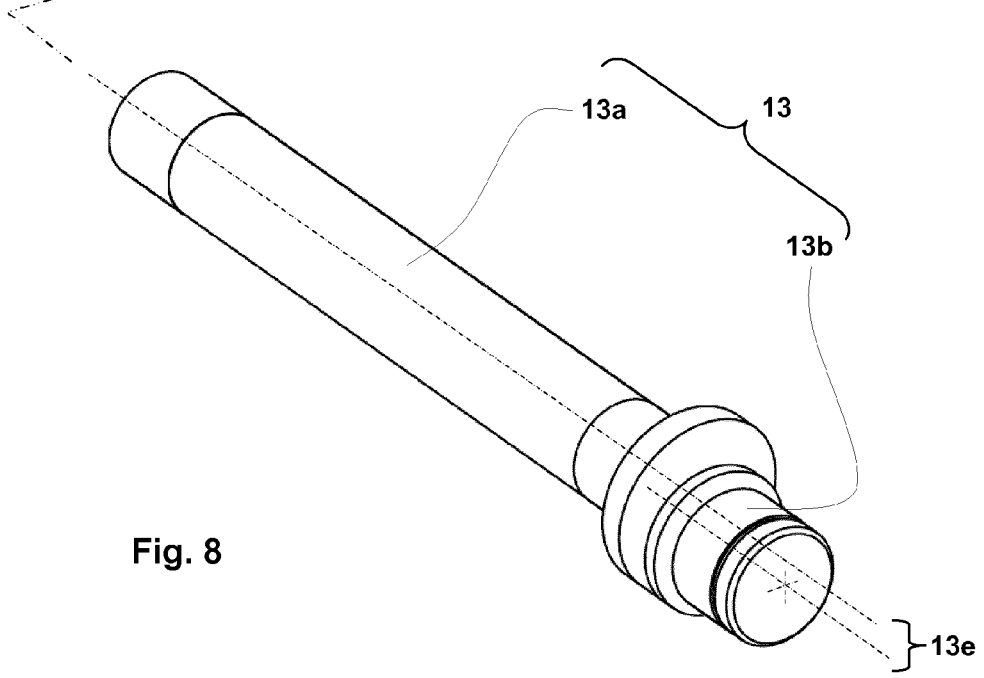
Fig. 8

ADJUSTABLE ROLLER-GUIDE SHOE

FIELD

The invention relates to a roller-guide shoe for guiding an elevator car or a counterweight in an elevator facility, and an elevator facility having a roller-guide shoe of this type.

BACKGROUND

The elevator facility is installed in a building. It consists, substantially, of a car, which is connected to a counterweight or a second car via suspension means. The car is driven along substantially vertical guide rails by means of a drive, which acts selectively on the suspension means or directly on the car or the counterweight. The elevator facility is used to transport people or freight inside a building through single or numerous stories.

The elevator facility contains devices for guiding the elevator car and/or the counterweight along the guide rails. For this, numerous roller-guides are used.

A roller-guide shoe of this type is known from patent publication FR1591623. This roller-guide shoe contains a roller bearing having two lateral rollers, which can be adjusted, by means of longitudinal grooves disposed diagonally in the roller bearing, to guide rails of different thicknesses, or to different axle spacings. A third, central roller is attached to the roller bearing via a spring-loaded lever. This roller-guide shoe requires a great deal of vertical space, because the diagonal longitudinal grooves require a great deal of space. In addition, oscillations of the lateral rollers, such as those occurring with the use of ball bearings, are transferred directly to the structure of the elevator car.

U.S. Pat. No. 5,107,963 discloses another roller-guide shoe. With this assembly, pneumatic springs and elastomer springs are used in order to obtain a good degree of operating comfort. These guide shoes also require a lot of space.

SUMMARY

The intention of the invention is to provide an easily adjustable roller-guide shoe, which requires little space, and which exhibits good operating characteristics. It should, in particular, be adaptable to guide rails of different sizes, or to different axle spacings, respectively.

The solutions described below fulfill at least some of these requirements.

A roller-guide shoe is proposed, which is suitable, in particular, for guiding an elevator car or a counterweight in an elevator facility. The roller-guide shoe comprises a roller bearing, having at least one guide roller, that can be attached to the car or the counterweight. The roller bearing is, for example, a part cast from aluminum or is formed, welded, or machined from sheet steel. The roller bearing further comprises a roller axle that accommodates the guide roller. The roller-guide shoe also exhibits at least one adapter incorporated in the roller bearing for positioning the roller axle in the roller bearing. This adapter has an installation contour, and the roller bearing is provided with a corresponding receiving contour for accommodating the adapter. The adapter exhibits a through hole for receiving the roller axle. This hole determines the center axis, which is determined by the center point of the hole.

The installation contour of the adapter is symmetrical, at least with respect to the first plane of symmetry for the adapter, and this first plane of symmetry runs parallel to the center axis. The hole for receiving the roller axle is laterally offset to the first plane of symmetry thereby, or, respectively, the center axis of the hole is disposed at a spacing to the first plane of symmetry for the adapter. In this manner the adapter can be secured in at least two different installation positions in the roller bearing with respect to the roller bearing, in that the adapter can be mounted in at least two positions in relation to the first plane of symmetry, which defines a symmetrical receiving and accommodating contour. The roller axle can be placed in different positions thereby, depending on the installation position of the adapter in the roller bearing. This is advantageous because, as a result of these different positions for the roller axle, different thicknesses of a guide beam, which is used for guiding the elevator car or a counterweight, can be adjusted to. Thus, the same roller-guide shoe material can be used for guide beams of different thicknesses.

This is advantageous, on one hand, because, for example for a specific guide beam, different roller diameters of guide rollers can be used. Thus, when the roller-guide shoe is used, for example, on a counterweight, a small guide roller can be used, wherein the adapter is then positioned such that the hole in the adapter is pushed closer to the guide beam. When the roller-guide shoe is used on an elevator car, a comparatively larger guide roller can be used, wherein the adapter is then positioned such that the hole in the adapter is spaced comparatively further away from the guide beam. This is advantageous because the counterweight is normally thin, and requires little space. For this reason, it is preferable to use small guide rollers on the counterweight.

Another advantage is that guide rollers of different diameters can be used in a roller-guide shoe, without having to use different roller bearings. As a result, it is possible to ensure that the potential damage points on numerous guide rollers do not come in contact with the guide rails at identical intervals or frequencies during operation of the elevator facility. This is advantageous because the damage points result in different disturbance frequencies during operation, due to the different roller diameters.

A roller-guide shoe of this type can be readily adapted to a required elevator guidance. Thus, a roller-guide shoe of this type can be provided wherein, based on ordering information or on adjustment tables, a required distance of the roller axle to a center of the roller-guide shoe is determined, and the adapter is positioned in the roller bearing in accordance with this determined distance by making use of the different possible adjustment positions. The ordering information contains thereby a desired rail head thickness and a desired guide roller diameter, for example, and the adjustment tables provide, based thereon, the required distance of the roller axle to the center of the roller-guide shoe, or a corresponding adjustment position for the adapter.

In one embodiment of the roller-guide shoe, the installation contour of the adapter also has a symmetrical design with respect to a second plane of symmetry for the adapter, and a line of intersection for the two planes of symmetry defines a central axis for the adapter. Preferably this central axis is parallel and at a spacing to the center axis. Furthermore, the installation contour is preferably not rotationally symmetrical; in particular, it is not circular. It exhibits at least one flat section or one projection. The corresponding counter-shape of the receiving contour on the roller bearing thus prevents a turning of the adapter in the roller bearing when acting together with the installation contour.

This is advantageous because, for different positions of the hole in the adapter in the roller bearing, the adapter can be inserted in the receiving contour of the roller bearing such that it is simply rotated about the central axis. Furthermore, this position is inevitably secured against turning after the insertion. Advantageously, the adapter is provided with an external shoulder, by means of which the adapter can be readily inserted in the receiving contour of the roller bearing, and the shoulder establishes an axial position of the adapter in the roller bearing.

In one embodiment of the roller-guide shoe, the installation contour of the adapter, as well as the receiving contour of the roller bearing, has the shape of a substantially equilateral polygon, such that the adapter can be secured in at least two rotational positions about the central axis of the adapter in the roller bearing, and the center axis of the hole for receiving the roller axle is disposed parallel and offset to the central axis. Preferably the corners of the polygon are rounded. This is advantageous because the numerous adjustment positions can be defined by the number of corners.

In an alternative embodiment of the roller-guide shoe, the installation contour of the adapter, as well as the receiving contour of the roller bearing, is in the shape of a rhombus, such that the adapter can be secured in the roller bearing in at least two different rotational positions about the central axis of the adapter, and the center axis of the hole for receiving the roller axle is disposed parallel and offset to the central axis.

In one embodiment of the roller-guide shoe, corners of the rhombus, or the polygon, respectively, are rounded, wherein, if necessary, the roundings of opposing corners of a polygon having an even number of corners, or the rhombus, are provided with the same radii in each case, and the roundings of adjacent corners are provided, accordingly, with different radii. This is advantageous because a shape of the adapter can be optimized, particularly when vibration-cushioned adapters are used.

In one embodiment of the roller-guide shoe, the adapter consists of a vibration-cushioning material, by means of which the roller axle is supported in the roller bearing such that it is cushioned against vibrations. This is advantageous because an oscillation, vibration, or noise transference from the roller-guide shoe to the elevator car can be damped or reduced with this measure, as a result of which, the operating characteristics of the roller-guide shoe are also improved.

In one embodiment of the roller-guide shoe, the adapter is made of a polyurethane, as a result of which the roller axle is supported in the roller bearing such that it is cushioned against vibrations. Optionally, the elasticity of the adapter is influenced by air pockets or air holes. This results in a cost-effective and beneficial design for the adapter.

In one embodiment of the roller-guide shoe, the hole for receiving the roller axle is a circular hole, and the roller axle exhibits a first, round axle region, designed to be positioned in the circular hole in the adapter. Preferably the roller axle also has a further bearing region, adjoining the first, round axle region, for receiving the guide rollers. This bearing region is preferably offset eccentrically to the first axle region. This is advantageous because then, by rotating the roller axle in the hole, a spacing of the guide roller axle to a guide beam can be adjusted in a continuous manner. As a result, it is possible, on one hand, to adjust a pressure of the guide roller on a guide beam. On the other hand, it is also possible to expand the adjustment range pertaining to different thicknesses of the guide beam in conjunction with the positioning of the hole in the adapter. In a preferred embodiment, the different positions of the adapter, or the roller axle in the roller bearing, for example, enable the use of different guide roller diameters, and the eccentric arrangement of the bearing region of the roller axle in relation to the axle region enables an adjustment of the roller-guide shoe to different thicknesses of the guide beam. In this manner, numerous embodiment variations can be implemented using identical basic materials. In this manner, storage costs and production costs can be kept low.

In one embodiment of the roller-guide shoe, the roller bearing is substantially symmetrical, and is designed to accommodate two lateral roller axles with guide rollers. As a result, one guide roller can be disposed on each of the lateral surfaces, or on two sides, respectively, of the guide beam.

The two lateral roller axles and guide rollers are each preferably attached to the roller bearing thereby via two adapters spaced apart from one another. As a result, guide forces can be introduced to the roller bearings via a pair of forces determined by the spaced apart adapters. In theory, the two lateral guide rollers, or even all of the guide rollers, can be connected to the elevator car or counterweight by their own roller bearings. The combining of rollers in one roller bearing, however, is particularly beneficial, because the guide points in a guide range can be implemented thereby without additional adjustments and with lower costs. The described design, with the symmetrical accommodation for the guide rollers and the introduction of the guide roller force via two, in each case, adapters at a spacing to one another, is particularly cost-effective thereby, because the individual bearing zones for the roller axle in the roller bearing are not affected by bending loads.

In one embodiment of the roller-guide shoe, the two lateral roller axles are furthermore connected by means of a connecting bracket, and secured against unintentional turning, wherein the connecting bracket exhibits different hole positions corresponding to the different positions of the roller axles in the roller bearing. This results, accordingly, in the possibility of different connection distances, by means of which displacement of the selected adjustment can be effectively prevented.

In one embodiment of the roller-guide shoe, the roller bearing enables an accommodation of an additional guide roller, which is positioned at a right angle to the guide roller disposed on the roller axle. Preferably the additional guide roller is supported in relation to the roller bearing via a spring-loaded lever and/or a limit stop damper. As a result, this additional guide roller can be pressed against a central guide surface of the guide beam. This is advantageous because this additional guide roller, acting laterally with respect to the car, normally must be coordinated to greater imprecisions. The use of the spring-loaded lever and/or a corresponding limit stop damper makes this possible.

As a matter of course, variations of the roller-guide shoe are possible. Thus, for example, instead of a second lateral guide roller, a second lateral guide surface in the form of a sliding surface can be used, if, for example, constant lateral forces are present, which determine a defined guide force direction. Likewise, further components, such as, for example, an emergency guide, can be integrated in the roller bearing. An emergency guide is used, for example, if a roller is damaged, as a result of an overload to the guide rollers, or a compression of a vibration-cushioned adapter is too great, e.g. in the event of an earthquake, improper loading or overloading of the elevator car, or suchlike.

DESCRIPTION OF THE DRAWINGS

In the following, designs for the invention shall be described in an exemplary manner, based on the figures.

Components having the same function are provided with the same reference symbols in the figures.

FIG. 7 shows an example of an adapter, FIG. 8 shows an example of a roller axle.

DETAILED DESCRIPTION

Figure 1:
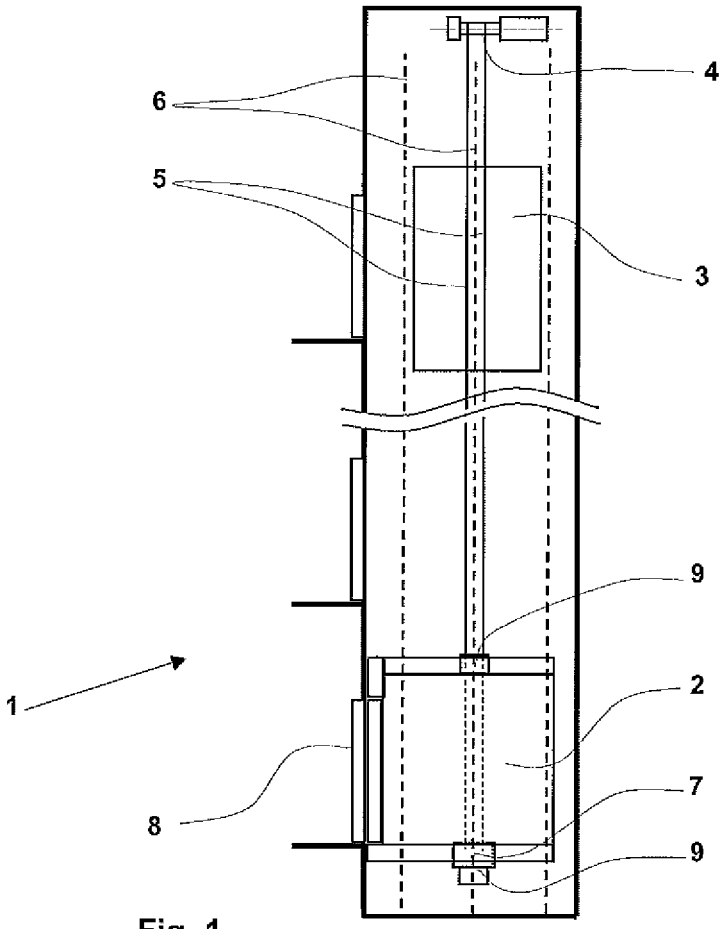
FIG. 1 shows a schematic view of an elevator facility in a side view.
Figure 2:
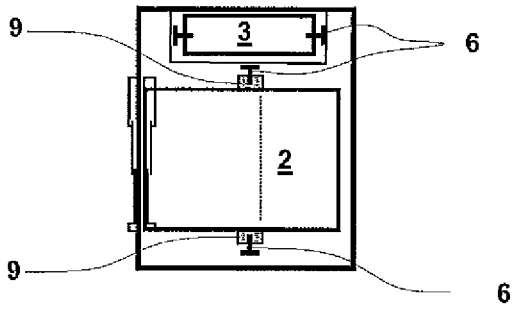
FIG. 2 shows a schematic view of the elevator facility in cross-section.

FIG. 1 shows an elevator facility 1 in a schematic side view, and FIG. 2 shows the elevator facility in a schematic view from above. The elevator facility 1 is installed in a building, and serves to transport people or freight within the building. The elevator facility 1 contains an elevator car 2, which can move up and down along guide rails 6. The elevator car 2 is provided with guide shoes 9 for this purpose, which guide the elevator car 2 as precisely as possible along a predefined travel path. The elevator car 2 is can be accessed from the building via shaft doors 8. A drive 4 serves to drive and stop the elevator car 2. The drive 4 is disposed, for example, in the upper region of the building, and the car 2 is suspended from the drive 4 with suspension means 5, e.g. suspension cables or suspension belts. The suspension means are further connected to a counterweight 3 via the drive 4. The counterweight 3 counterbalances a portion of the mass of the elevator car 2, such that the drive 4 primarily needs only to equalize an imbalance between the car 2 and the counterweight 3. The drive 4 is disposed, by way of example, in the upper region of the building. As a matter of course, it can also be disposed at another location in the building, or in the region of the car 2 or the counterweight 3.

The elevator car 2 is also provided with a brake system 7, which can stop and brake the elevator car 2. As with the elevator car 2, the counterweight 3 is also guided along guide rails 6 by means of guide shoes 9. Because the counterweight 3 has smaller dimensions, and is retained substantially in the center by the suspension means 5, the dimensions for the guide rails 6 for the counterweight 3 can normally be smaller than those for the guide rails 6 for the elevator car 2. The guide shoes 9 for the counterweight 3 are, as a matter of course, adapted to the size of the guide rails 6. The elevator car 2 and the counterweight 3 are normally guided by four guide shoes 9 in each case, wherein there are two guide shoes 9 on each side of the elevator car 2, or the counterweight 3, respectively, which are disposed on the upper and lower end regions thereof, and which act together with a guide rail 6. With the guide shoes 9, a distinction is made between sliding-guide shoes and roller-guide shoes. Hybrids thereof are also known, in which there are both sliding regions and rolling regions. In the present example, roller-guide shoes 9 are used.

Figure 3:
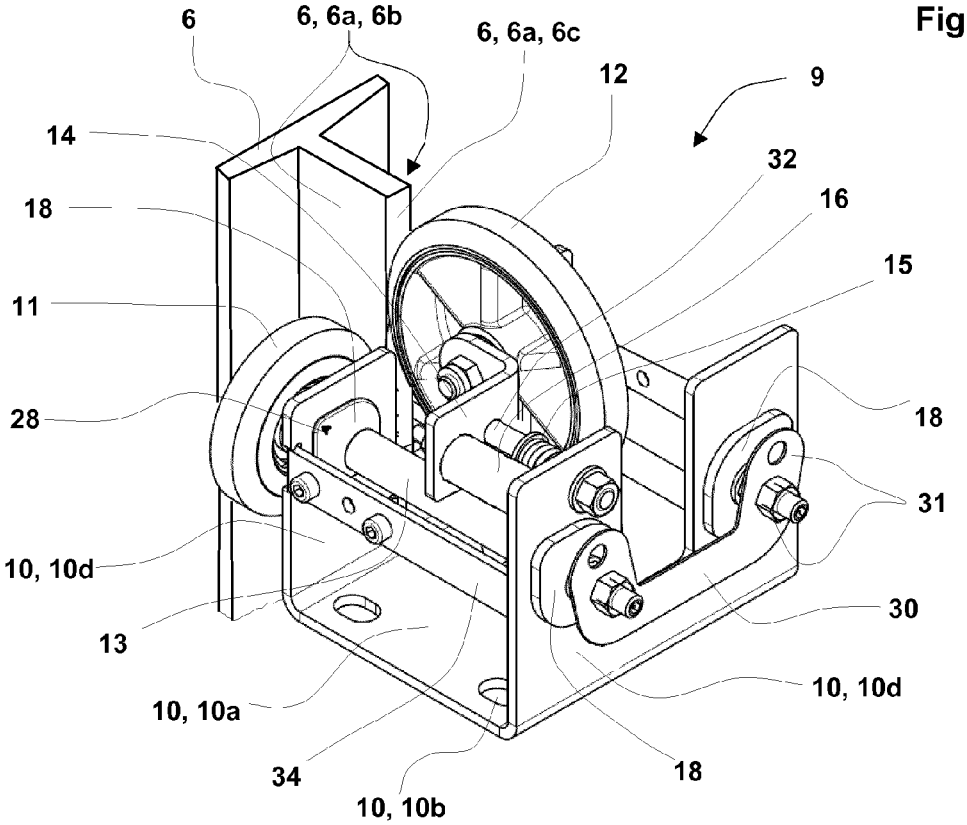
FIG. 3 shows a perspective view of a roller-guide shoe.

FIG. 3 illustrates how a roller-guide shoe 9 encompasses a guide rail 6, or a guide beam 6*a* of the guide rail, respectively, on three sides. A first guide roller 11 and a second guide roller 11 (not visible in FIG. 3) are disposed on opposing lateral surfaces 6*b* of the guide beam 6*a*, and a further, third guide roller 12 is oriented transverse, or at a right angle, to the other two guide rollers 11, such that it runs on a central guide surface 6*c*, or a head surface, of the guide beam 6*a*, extending between the two lateral surfaces 6*b*.

The guide rollers 11 are supported in a roller bearing 10. The roller bearing 10 has a base surface 10*a*, which is provided with attachment holes 10*b* in the example, in order that the roller-guide shoe 9 can be attached to the elevator car 2 or to the counterweight 3.

Figure 4:
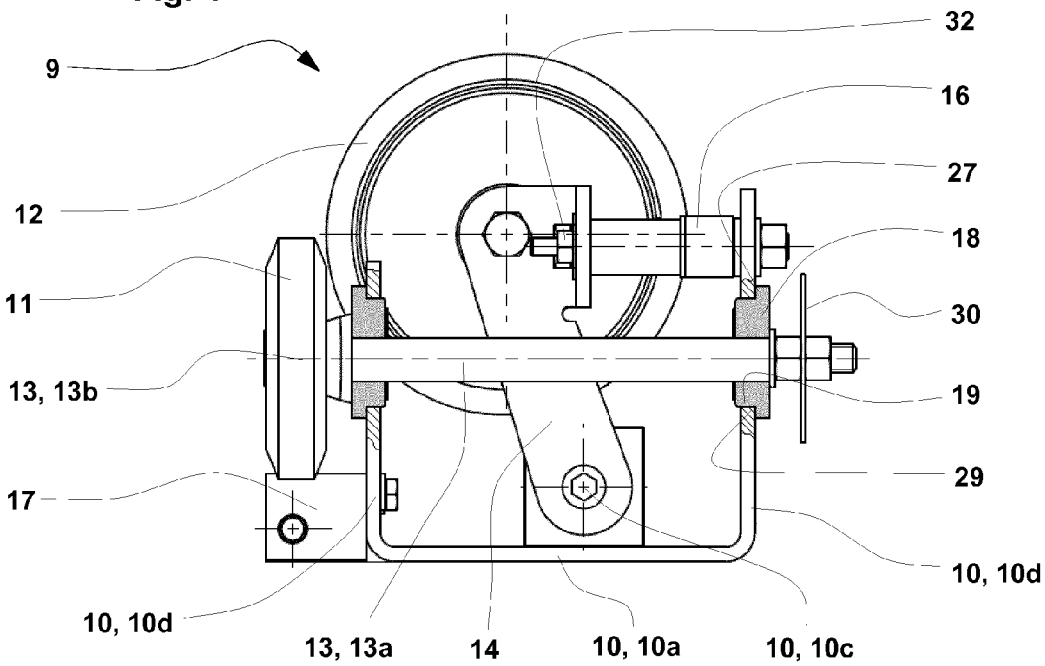
FIG. 4 shows a side view of the roller-guide shoe from FIG. 3.

The third guide roller 12, see FIGS. 3 and 4, is attached to the roller bearing 10 by means of a spring-mounted lever 14. The spring-mounted lever 14 is pivotally supported in the roller bearing 10 via a lower bearing 10*c*, and the third guide roller 12 is rotatably supported on an opposite end of the spring-mounted lever 14. The spring-mounted lever 14, when the roller guide 9 is installed in the elevator facility 1, is pressed against the head surface 6*c* of the guide beam 6*a* by a pressure spring 15, which is supported against the roller bearing 10. In the example, as a supplement to the pressure spring 15, a limit stop buffer 16 is used, which limits a displacement of the third guide roller 12. The limit stop buffer 16 and the pressure spring 15 are connected, on one side to the roller bearing 10 and on the other side to the spring-mounted lever 14, via associated, adjustable attachment means 32.

As a matter of course, in place of the third guide roller 12, a simple sliding surface can be used, or the third guide roller 12 can also be secured without a spring-mounted lever 14. As is illustrated in the example, the third roller 12 preferably has a greater diameter than that of the two other guide rollers 11. This takes into account guide forces of different strengths.

In the example according to FIG. 3, an optional attachment bracket 34 is also visible, which connects the two shoulders 10*d* of the roller bearing. This attachment bracket 34 can be used to secure a possible protective cover (not shown), for example. It can also be used to reinforce the roller bearing 10, if this is necessary for structural reasons.

The first, and in the example, also the second guide rollers 11 are supported in the roller bearing 10 by means of a roller axle 13. The roller bearing 10 has two shoulders 10*d* for this, extending from the base surface 10*a* of the roller bearing 10, which accommodate the roller axles 13. The shoulders 10*d* are bent sections of sheet metal, for example, but a plate having a welded construction could also be used. The roller axle 13 is secured to the roller bearing 10 via two adapters 18, or a pair of adapters 18, respectively. The adapters 18 are disposed in the two shoulders 10*d* of the roller bearing 10 for this purpose. A guide force acting on the first or second guide roller 11 can be introduced in an optimal manner into the roller bearing 10 via the two shoulders 10*d*.

Figure 9:
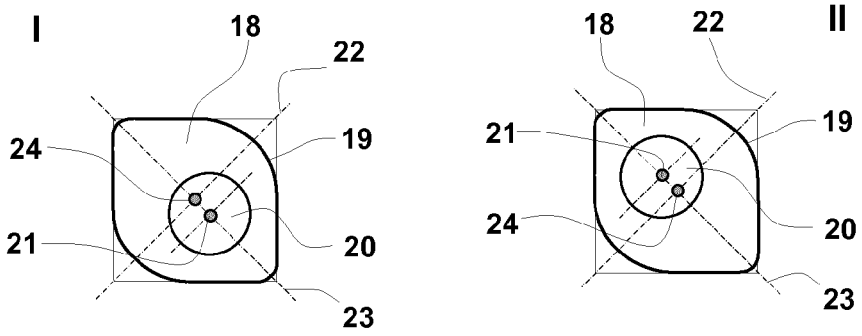
FIG. 9 shows, schematically, the adapter from FIG. 7 in different installation positions.

The adapter 18, as depicted in FIG. 7, is a component produced from polyurethane in a first embodiment, having an installation contour 19, which, according to the depiction in FIG. 9, is an equilateral rectangle or rhombus, and in this example is actually a square.

The shown adapter 18 is produced from polyurethane, and in this embodiment it also exhibits closed or open air pockets 25. These are optional. An elasticity and a damping behavior can be influenced by the arrangement of such air pockets 25 or air holes.

The installation contour 19 has rounded corners, wherein opposing corners of the installation contour 19 are provided in each case with the same radii and adjacent corners of the rhombus are provided with different radii. This installation contour 19 fits into the corresponding receiving contour 29 (FIG. 4) formed in the shoulders 10*d* of the roller bearing 10.

The adapter 18 has an adapter shoulder 26. This adapter shoulder 26 forms a stop 27. As a result, the adapter 18 can simply be placed in the corresponding receiving contour 29 of the roller bearing 10. The adapter 18 has a through hole 20 for receiving the roller axle 13. How the roller axle 13 can be placed in the hole 20 in the adapter 18 is illustrated in FIGS. 7 and 8. This hole 20 defines a center axis 21, or the axis passing through the center of the hole 20.

The installation contour 19 of the adapter 18 is symmetrical in the example in FIGS. 7 and 9 with respect to a first plane of symmetry 22 for the adapter 18, and it runs parallel to the center axis 21. The center axis 21 of the hole 20 is, furthermore, disposed at a spacing to the first plane of symmetry 22 for the adapter 18. Furthermore, in the example the installation contour 19 of the adapter 18 is also symmetrical with respect to a second plane of symmetry 23 for the adapter 18, wherein a line of intersection for the two planes of symmetry defines a central axis 24 for the adapter. This central axis 24 of the adapter 18 is disposed parallel and at a spacing to the center axis 21.

Figure 5:
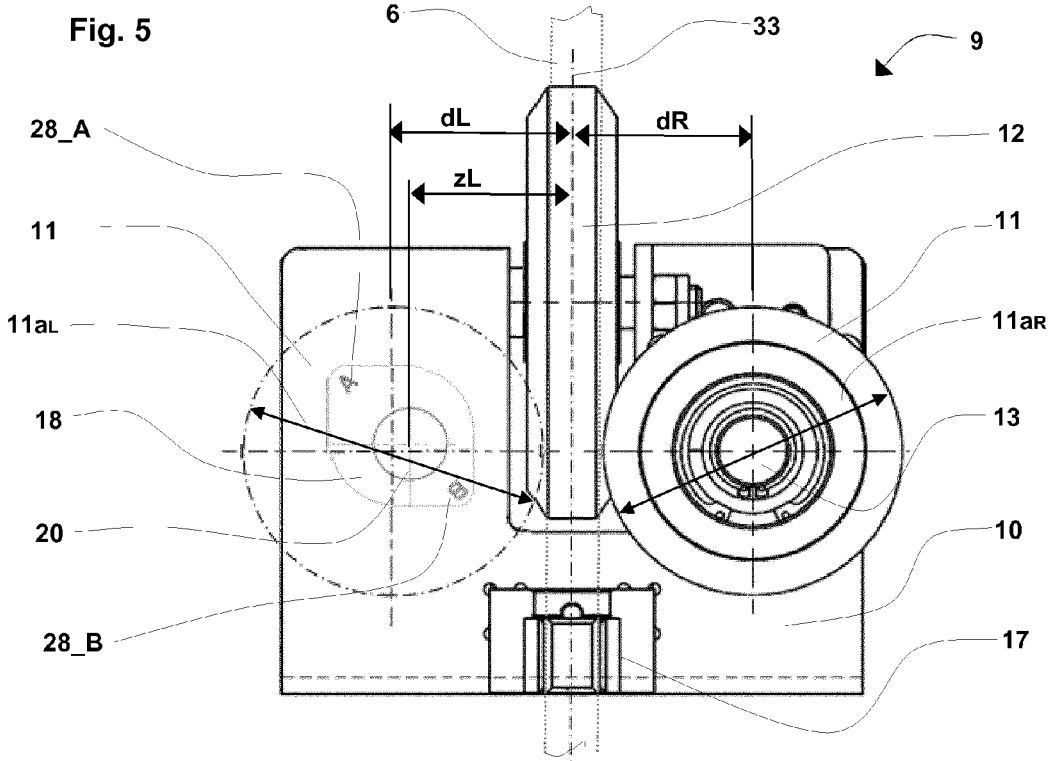
FIG. 5 shows a front view of the roller-guide shoe from FIG. 3, in a first setting.
Figure 6:
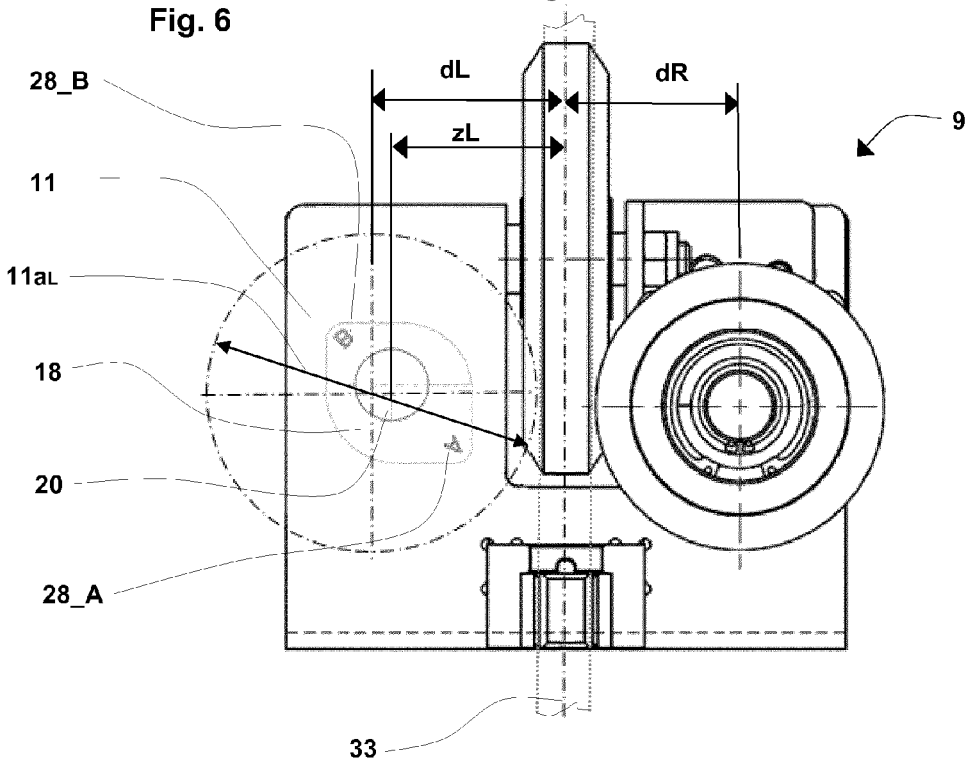
FIG. 6 shows a front view of the roller-guide shoe from FIG. 3 in a second setting.

The adapter 18 in this design can be secured in the roller bearing 10 in two different installation positions in relation to the roller bearing 10, as can be seen in FIGS. 5, 6 and 9, and the roller axle 13 can be positioned in the two different positions thereby, depending on the installation position of the adapter 18 in the roller bearing 10.

In FIGS. 5 and 9 (position I) the adapter 18 is inserted in the receiving contour 29 such that the center axis 21 of the adapter 18, and thus the roller axle 13, is pushed to the center 33 of the roller-guide shoe 9, and in FIGS. 6 and 9 (position II) it is inserted in the receiving contour 29 such that the center axis 21 of the adapter 18, and thus the roller axle 13, is pushed to a position at a spacing to the center 33 of the roller-guide shoe 9. A spacing zL of the center axis 21 of the adapter 18 to the center 33 of the roller-guide shoe 9, or, respectively, a spacing dL of the roller axle 13 to the center 33 of the roller-guide shoe 9 is increased in the position of the adapter 18 according to FIG. 6 in comparison to FIG. 5. This greater spacing enables the use of a thicker rail 6, or it enables, as in the example in FIG. 6, the use of a guide roller 11 having a greater diameter 11*a*L.

For illustrative purposes, the adapter 18 is provided with a label 28. A first installation position is indicated with an A 28A, and a second installation position is indicated with a B 28B. By this means, the correct installation position can be readily discerned at any time.

In one embodiment example the spacing between the center axis 21 of the hole and the first plane of symmetry 22 for the installation contour 19 is selected such that in one case a guide roller 11 having a diameter of 100 mm can be used. In the other installation position a guide roller 11 having a diameter of 120 mm can be used. The size of the rollers 11 can be predefined depending on the requirements. The requirements are defined, for example, by the installation site. Numerous small roller diameters are desirable for the counterweight 3, because the counterweight 3 has small lateral dimensions, and greater roller diameters are then desirable for the car 2, because there is more space available there, and furthermore, a better operating characteristic is demanded.

The installation position, which is selected once, is then secured with a connecting bracket 30, as is illustrated in FIG. 3, The connecting bracket 30 connects the roller axles 13 on both sides of the two lateral guide rollers 11 to one another. The connecting bracket 30 is prepared with two different hole positions 31 in the example. A selected installation position of the adapter 18 can also be quickly discerned thereby, and it can no longer be unintentionally displaced after it has been secured by the connecting bracket 30.

In the present embodiment example according to FIGS. 3 to 8, the roller axle 13, see FIG. 8, also exhibits a first, round axle region 13*a*, which is designed to be positioned in the circular hole 20 in the adapter 18, and the roller axle 13 exhibits a bearing region 13*b* for receiving the guide roller 11. The bearing region 13*b* is then eccentrically 13*e* offset to the first axle region 10*a* according to this embodiment example.

A distance to the guide rollers 11 can then additionally be adjusted by turning the roller axle 13. In the embodiment example the two adjustment positions of the adapter 18 are used for variations of the roller diameters 11*a*L, 11*a*R of the lateral guide rollers 11, and the eccentricity 13*e* of the roller axle 13 is used for adjusting to different thicknesses of the guide beam 6*a*. Thus, the diameter of the guide rollers can be selected to be either 100 mm or 110 mm by means of the two adjustment positions of the adapter 18 in the embodiment example according to FIGS. 3 to 8, and a thickness of the guide beam 6*a* of basically 7 mm to 15 mm can be adjusted to by means of the eccentric design for the roller axle 13. These ranges in variation can be determined by the selection of the eccentricity 13*e* for the roller axle 13 and the displacement of the center axis 21 of the hole 20 in the adapter 18 to the first plane of symmetry 22 thereof.

Furthermore, the roller-guide shoe 9 is provided with an emergency guide 17, see FIGS. 4 to 6. The emergency guide 17 is permanently connected to the roller bearing 10. It accommodates forces that occur at greater guide forces, when, for example, the guide rollers 11 are compressed too strongly due to an overload.

By varying the adapter 18, and of course the corresponding receiving contour 29 in the roller bearing 10, different adjustment variations can be obtained. FIG. 9 shows the adapter 18 as it has already been explained. The installation contour 19 of the adapter 18 symmetrical with respect to a first plane of symmetry 22 for the adapter 18 and it runs parallel to the center axis 21. The center axis 21 of the hole 20 is disposed, accordingly, at a spacing to the first plane of symmetry 22 for the adapter 18. Furthermore, in this example the installation contour 19 of the adapter 18 is also symmetrical with respect to a second plane of symmetry 23 for the adapter 18, wherein a line of intersection for the two planes of symmetry 22, 23 defines a central axis 24 for the adapter 18. This central axis 24 for the adapter 18 is thus likewise disposed parallel and at a spacing to the center axis 21. The installation contour 19 has rounded corners, wherein opposing corners of the installation contour 19, in each case, are provided with identical radii, and adjacent corners of the rhombus are provided with different radii. An adapter 18 designed in this manner can be adjusted to two different positions. FIG. 9 (position I) shows a first position and FIG. 9 (position II) shows a second position, wherein the adapter 18 is rotated 180° about the central axis 24. As a result, the hole 20 is placed in a second position accordingly.

Figure 11:
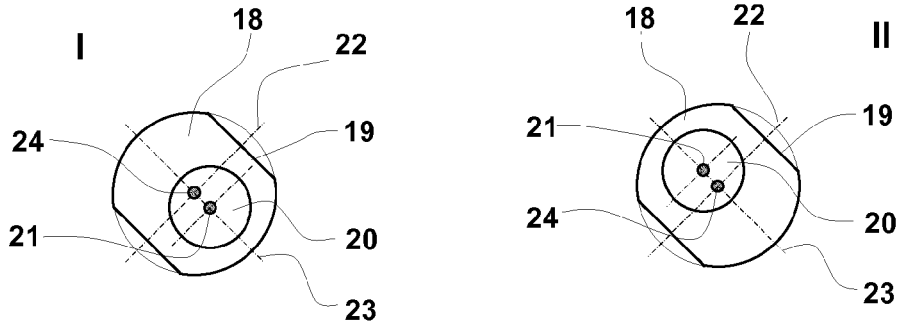
FIG. 11 shows, schematically, a further adapter in different installation positions.
Figure 12:
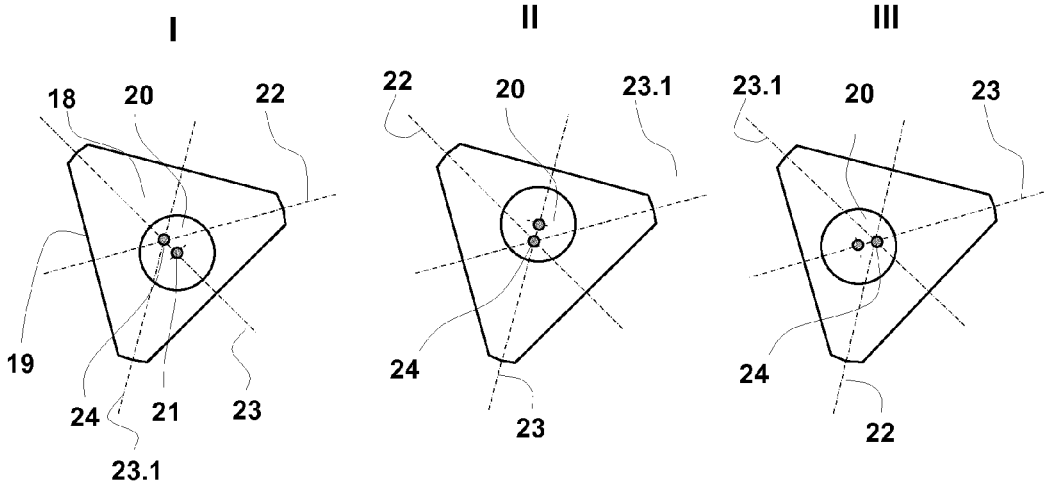
FIG. 12 shows, schematically, a further adapter in different installation positions.
Figure 13:
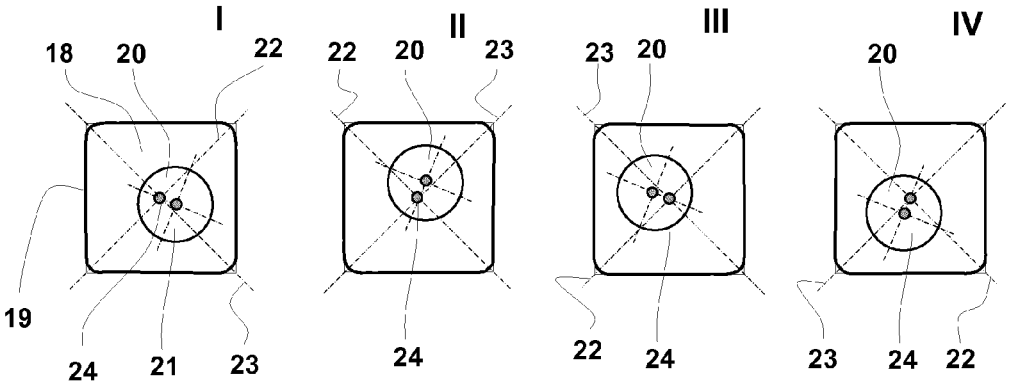
FIG. 13 shows, schematically, a further adapter in different installation positions.

FIGS. 11 to 13 show further forms of the adapter 18, wherein in FIG. 11 a symmetrically flattened cylinder defines the installation contour 19 of the adapter 18. An adapter 18 designed in this manner can also be adjusted to two different positions. FIG. 11 (position I) shows a first position and FIG. 11 (position II) shows a second position, wherein the adapter 18 is also rotated in this example 180° about the central axis 24. As a result, the hole 20 is placed in a second position accordingly.

In FIG. 12 an installation contour 19 is designed in the shape of a polygon having two second planes of symmetry 23, 23.1. The central axis 24 is defined by the line of intersection for the three planes of symmetry 22, 23, 23.1. An adapter 18 designed in this manner can be adjusted to three different positions accordingly. FIG. 12 (position I) shows a first position, FIG. 12 (position II) shows a second position, and FIG. 12 (position III) shows a third position, wherein the adapter 18 is rotated 120° about the central axis 24 in each case in this example. As a result, the hole 20 is placed in a second or third position accordingly.

In FIG. 13 an installation contour 19 is designed in the shape of a square, wherein the corners are each rounded with the same radius. The adapter 18, or the installation contour 19, respectively, has a second plane of symmetry 23. The central axis 24 is defined by the line of intersection for the two planes of symmetry 22, 23. In differing from the preceding embodiments, the center axis 21 is offset asymmetrically to the central axis 24 in this example. The center axis thus does not lie on a plane of symmetry. An adapter 18 designed in this manner can then be adjusted to four different positions. FIG. 13 (position I) shows a first position, FIG. 13 (position II) shows a second position, FIG. 13 (position shows a third position, and FIG. 13 (position IV) shows a fourth position, wherein the adapter 18 is rotated 90° about the central axis 24 in each case in this example. As a result, the hole 20 is placed in a second, third or fourth position, accordingly.

Figure 10:
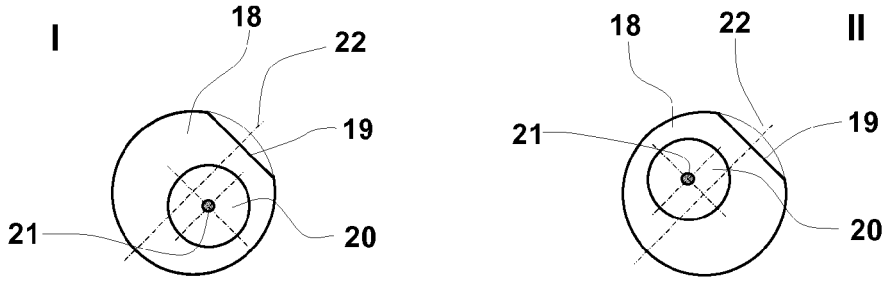
FIG. 10 shows, schematically, another adapter in different installation positions.

In FIG. 10 a cylinder flattened on one side defines the installation contour 19 of the adapter 18. This installation contour 19 is only symmetrical with respect to the first plane of symmetry 22, and the center axis 21 of the hole 20 is disposed at a distance to this first plane of symmetry 22. An adapter 18 designed in this manner can also be set in two different positions. FIG. 10 (position I) shows a first position and FIG. 10 (position II) shows a second position, wherein the adapter 18 is not rotated in this example, but instead, it is reversed over the plane of symmetry. As a result, the hole 20 is placed in a second position accordingly.

The depicted embodiments are exemplary. The person skilled in the art adapts the invention to the requirements. Instead of polyurethane, he can also use rubber or other materials. The roller axle 13 can be a straight axle, without an eccentric bearing region. The two lateral rollers can have the same diameter, but they can also have different diameters in the same roller-guide shoe 9.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A roller-guide shoe for guiding an elevator car or a counterweight in an elevator facility, comprising:

a roller bearing adapted to be attached to the car or the counterweight;

at least one guide roller;

at least one roller axle disposed in the roller bearing and receiving the guide roller;

at least one adapter installed in the roller bearing for positioning the roller axle in the roller bearing, wherein the adapter has an installation contour, which fits to a corresponding receiving contour in the roller bearing, the adapter having a through hole receiving the roller axle, the hole having a center axis, the installation contour being symmetrical at least with respect to a first plane of symmetry for the adapter, wherein the first plane of symmetry extends parallel to the center axis, and the center axis of the hole being disposed at a spacing from the first plane of symmetry such that the adapter can be secured in at least two different installation positions in the roller bearing, and the roller axle is placed in different positions in the roller bearing depending on the installation position of the adapter.

2. The roller-guide shoe according to claim 1 wherein the installation contour of the adapter is furthermore symmetrical with respect to a second plane of symmetry for the adapter, and a line of intersection for the two planes of symmetry defines a central axis for the adapter, which central axis is disposed parallel to and at a spacing from the center axis, and wherein the receiving contour of the roller bearing, cooperating with the installation contour, prevents a turning of the adapter in the roller bearing.

3. The roller-guide shoe according to claim 2 wherein the installation contour of the adapter, as well as the receiving contour of the roller bearing, are in a shape of a substantially equilateral polygon, such that the adapter can be secured in at least two different rotational positions in the roller bearing about the central axis of the adapter, and the center axis of the hole receiving the roller axle is disposed parallel to and offset from the central axis, wherein corners of the polygon are rounded.

4. The roller-guide shoe according to claim 2 wherein the installation contour of the adapter, as well as the receiving contour of the roller bearing, are in a shape of a rhombus, such that the adapter can be secured in at least two different rotational positions in the roller bearing about the central axis of the adapter, and the center axis of the hole for receiving the roller axle is disposed parallel to and offset from the central axis, wherein corners of the rhombus are rounded.

5. The roller-guide shoe according to claim 4 wherein roundings of opposing ones of the corners of the rhombus are formed with a same radii, and roundings of adjacent ones of the corners of the rhombus are formed with different radii.

6. The roller-guide shoe according to claim 1 wherein the adapter is formed of an oscillation damping material to support the roller axle in the roller bearing to be cushioned against vibrations.

7. The roller-guide shoe according to claim 6 including at least one air pocket or air hole formed in the adapter to affect an elasticity of the adapter.

8. The roller-guide shoe according to claim 1 wherein the adapter is formed of a polyurethane material to support the roller axle in the roller bearing to be cushioned against vibrations.

9. The roller-guide shoe according to claim 1 wherein the hole receiving the roller axle is a circular hole, and the roller axle has a first, round axle region, configured to be positioned in the circular hole in the adapter, and the roller axle has a bearing region for receiving the guide roller, wherein the bearing region is offset eccentrically relative to the first axle region.

10. The roller-guide shoe according to claim 1 wherein the roller bearing is substantially symmetrical and receives two of the roller axle each with one of the guide roller received thereon, the guide rollers being disposed on opposite sides of a guide beam, wherein the two roller axles and the two guide rollers are each attached to the roller bearing with two of the adapter spaced apart from one another, wherein guide forces are introduced into the roller bearing by a pair of forces generated by the spaced apart adapters.

11. The roller-guide shoe according to claim 10 wherein the two roller axles are connected by a connecting bracket, and are secured against turning, wherein the connecting bracket has different hole positions corresponding to the different positions for the roller axles in the roller bearing.

12. The roller-guide shoe according to claim 10 wherein the roller bearing accommodates a further guide roller, which is disposed at a right angle to the two guide rollers disposed on the two roller axles, and which is supported by at least one of a spring-loaded lever and a limit stop damper with respect to the roller bearing, wherein the further guide roller is pressed against a central guide surface on the guide beam.

13. An elevator facility having a plurality of the roller-guide shoe according to claim 1 attached to at least one of the elevator car and the counterweight.

* * * * *